US006540596B1

(12) United States Patent
Van Der Veen

(10) Patent No.: US 6,540,596 B1
(45) Date of Patent: Apr. 1, 2003

(54) MOBILE SURFACING MACHINE

(76) Inventor: Timothy Roelf Van Der Veen, 2/56 Elsie Street, Boronia, Victoria 3155 (AU)

( * ) Notice: Subject to any disclaimer, the term of this patent is extended or adjusted under 35 U.S.C. 154(b) by 0 days.

(21) Appl. No.: 09/720,769

(22) PCT Filed: Jul. 6, 1999

(86) PCT No.: PCT/AU99/00545

§ 371 (c)(1),
(2), (4) Date: Apr. 9, 2001

(87) PCT Pub. No.: WO00/01291

PCT Pub. Date: Jan. 13, 2000

(30) Foreign Application Priority Data

Jul. 6, 1998 (AU) ..... PP4499

(51) Int. Cl.[7] ..... B24B 23/00
(52) U.S. Cl. ..... 451/350; 451/357
(58) Field of Search ..... 451/350, 351, 451/352, 353, 357; 15/49.1, 98

(56) References Cited

U.S. PATENT DOCUMENTS

| | | | | | |
|---|---|---|---|---|---|
| 4,097,950 | A | * | 7/1978 | Satterfield | 15/49 R |
| 4,862,548 | A | * | 9/1989 | Sergio | 15/49 R |
| 5,637,032 | A | * | 6/1997 | Thysell et al. | 451/259 |
| 5,863,241 | A | | 1/1999 | Rottschy | |

FOREIGN PATENT DOCUMENTS

| | | |
|---|---|---|
| DE | 29812213 | 12/1998 |
| FR | 2458356 | 1/1981 |
| WO | 9408752 | 4/1994 |

* cited by examiner

*Primary Examiner*—George Nguyen
*Assistant Examiner*—Dung Van Nguyen
(74) *Attorney, Agent, or Firm*—James Ray & Associates

(57) ABSTRACT

A mobile surfacing machine includes a frame to which a planetary head is rotatably mounted, at least one satellite head rotatably mounted within the planetary head, the at least one satellite head being adapted for grinding a surface, a first drive mechanism for driving the planetary head and a second drive mechanism for driving the at least one satellite head, wherein the first drive mechanism and the second drive mechanism are independently operable.

17 Claims, 3 Drawing Sheets

MOBILE SURFACING MACHINE

BACKGROUND OF THE INVENTION

1. Field of the Invention

The present invention relates generally to a mobile surfacing machine suitable for use in surfacing flooring. In particular the present invention relates to planetary surfacing machines suitable for use on concrete, stone and wooden floors.

The surfacing machine of the present invention may be used for various domestic, commercial and industrial applications where surfacing is required. The surfacing machine of the present invention is particularly well adapted for use in surfacing floors, particularly floors constructed of concrete, stone or wood. Even though the present invention is described with particular reference to surfacing floors, it is not limited to this use and can be used on a variety of surfaces, indoors and outdoors.

2. Description of Related Art

Surfacing machines are commonly used to strip or smooth flooring by grinding away any material adhered to the flooring and, if necessary, grinding away part of the flooring. They can provide a clean, smooth and essentially flat surface to which new coverings or coatings can be applied. Builders and renovators for examples often use surfacing machines to remove adhesive which has been used to adhere linoleum, tiles or other coverings to a floor and to remove coatings of varnish, paint or polymer (such as epoxy based coatings).

Surfacing machines are also commonly used to smooth a rough flooring surface or remove surface leveling compounds so as to create a floor having a smooth, level surface. Certain surfaces, including some types of concrete, are also suitable for polishing using a surfacing machine.

One of the best known types of floor surfacing machine is the planetary-type machine. These machines generally include three satellite surfacing heads within a planetary head, with the planetary and satellite heads rotating in opposite directions. Typically the satellite heads in these machines are driven and the planetary head rotates at a rate which is primarily governed by the amount of friction created between the satellite heads and the floor being surfaced. Accordingly, if the satellite heads are driven at high speed in order to rapidly grind the surface, the planetary head tends to rotate rapidly also, but this can cause the machine to bounce and become difficult to control when used on rough floors. However, if the satellite heads are slowed to improve the stability of the machine the production capacity and economy of the surfacing machine is reduced. Moreover, when the satellite heads are driven at high speed in order to improve the production capacity of the surfacing machine, wear on the machine parts and surfacing heads is increased.

U.S. Pat. No. 5,637,032 describes a floor surfacing machine generally of this type but further including a belt pulley attached to the frame of the surfacing machine, belt pulleys arranged on the shafts of the surfacing discs, and a belt running around these and the belt pulley attached to frame for the purpose of controlling the rotation of the planetary head. However the arrangement described therein is suitable only to limit the rate of rotation of the planetary head. This arrangement serves little purpose under operating conditions where there are substantial frictional forces between the satellite heads and the floor to be surfaced, since the rate of rotation of the planetary head is already limited by these frictional forces. Under conditions where relatively low frictional forces exist between the satellite heads and the floor to be surfaced, the belt may limit the rate of rotation of the planetary head, but when effective, the belt governing the motion of the planetary head does so in a relation that is in direct proportion to that of the satellite heads, and this allows for little flexibility in the modes of operation of the machine. The present invention provides a machine in which greater stability of operation can be achieved with dramatically increased production capacity and flexibility of operation.

SUMMARY OF THE INVENTION

According to the present invention there is provided a mobile surfacing machine including a frame to which a planetary head is rotatably mounted, at least one satellite head rotatably mounted within the planetary head, the at least one satellite head being adapted for grinding a surface, a first drive mechanism for driving the planetary head and a second drive mechanism for driving each satellite head, wherein the first and second drive mechanisms are independently operable.

Typically, the mobile surfacing machine includes a plurality of satellite heads, preferably three heads, although machines with four satellite heads are also envisaged.

Typically, each of the satellite heads includes a surfacing disc arranged on a corresponding shaft rotatably mounted within the planetary head. In this arrangement, each of the shafts is driven by a second drive mechanism, which includes a belt pulley mounted to each of the shafts and a drive belt run around each of the belt pulleys and driven by a motor mounted to the frame.

In a particularly preferred embodiment of the invention, the second drive mechanism includes a belt tensioning device. Typically, the belt tensioning device includes a belt tensioning pulley and is used to tension the drive belt passing around the belt pulleys mounted to the satellite shafts. The tensioning device simplifies assembly and servicing of the surfacing machine because the belt can be tensioned after a disassembled machine is reassembled.

Preferably, the first drive mechanism includes a motor which drives the planetary head via a series of geared pulleys and belts.

It will be appreciated that the first drive mechanism and second drive mechanism are independent systems driven by separate motors and operate entirely independently. As a result the satellite heads and planetary head are driven independently, and can be driven in a mutually opposing direction of rotation or in the same direction of rotation, and can be driven at different speeds independently of one another. This allows the operator to, for example, drive the planetary head at a relatively low rate over a rough floor so that the mobile surfacing machine does not bounce when it strikes rough patches but still drive the satellite heads at relatively high speed so as to maintain production capacity of the machine. If the surface is to be only lightly finished, the planetary head may be driven quickly so that the surfacing machines covers the floor surface at a rapid rate and the satellite heads remain in contact with any given portion of the floor for only a relatively short time. On the other hand, if one wishes to remove a relatively large proportion of the surface, the planetary head may be slowed down so that the satellite heads remain in contact with any given portion of the floor for a comparatively longer period of time. This provides the surfacing machine of the present invention with considerable flexibility in its applications.

BRIEF DESCRIPTION OF THE DRAWINGS

Preferred embodiments of the invention will now be described, by way of example only, with reference to the accompanying drawings, in which.

DETAILED DESCRIPTION OF THE INVENTION

The surfacing machine illustrated in the Figures has a frame that includes a motor mounting plate 2 and a control chassis (not shown) which is attached to the nib 1 and provides an arrangement by which the operator can move the machine over the floor to be surfaced. Typically this is a handle arrangement with appropriate provision made for the necessary connections to be made to allow a control panel, for control of the operation of the machine, to be provided on the handle arrangement.

The apparatus further includes a planetary head 3 consisting of a cylindrical wall 3*b* closed at both ends by a top plate 3*a* and bottom plate 3*c*. The motor mounting plate 2 is mounted upon the planetary head 3 by means of the main bearing assembly which includes the main bearing mount 2*a* which is a fixed extension of the motor mounting plate, the main bearing housing 3*d* which is fixed to the planetary head 3 and the main bearing 3*e*. It has a pulley 13 secured to top plate 3*a*, and can be driven to rotate in either direction by belt 13*a* which is wrapped around pulley 13 and driven by the first drive mechanism.

Figure 1:
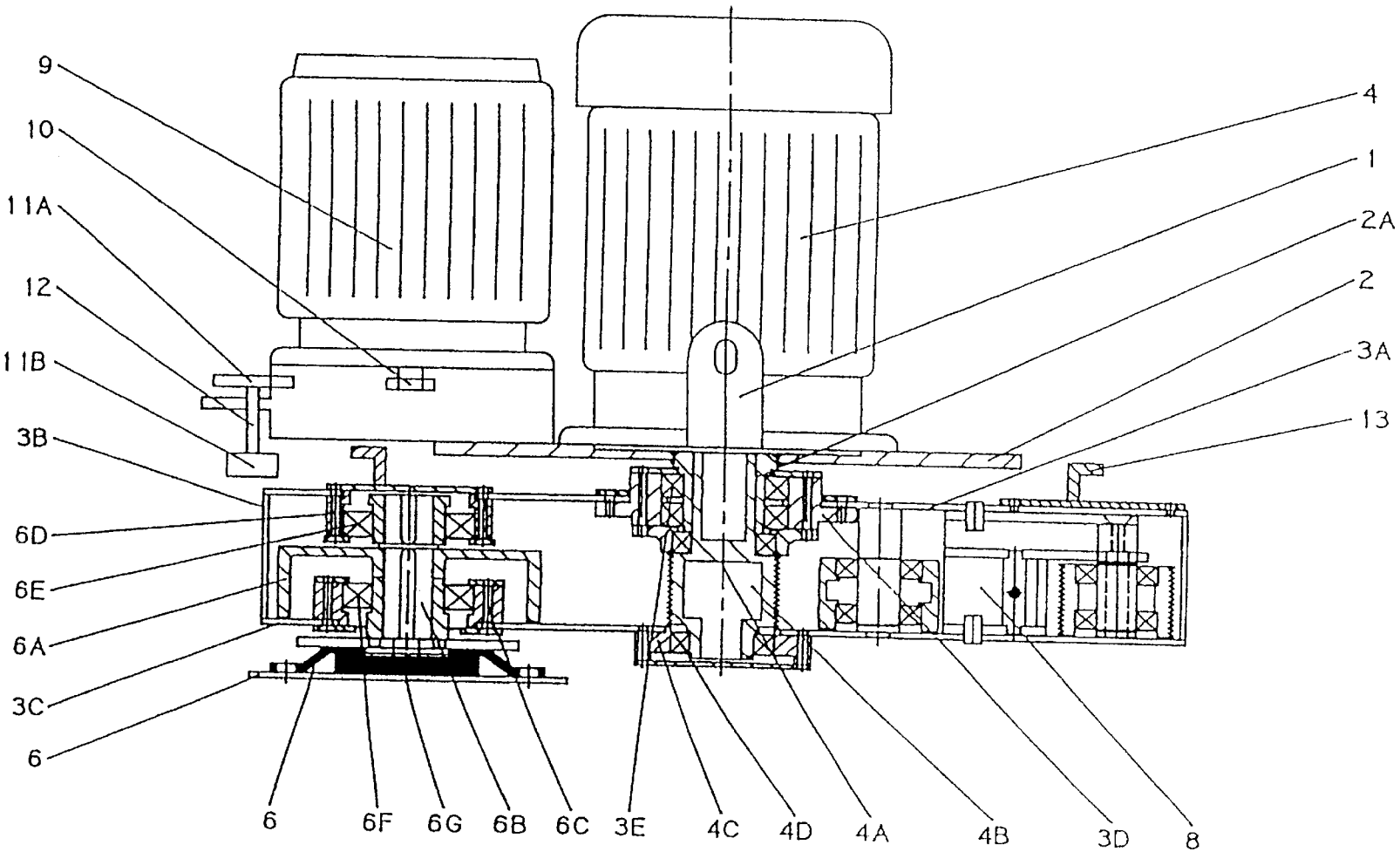
FIG. 1 is a cross sectional view of one embodiment of the machine in accordance with the present invention.
Figure 3:
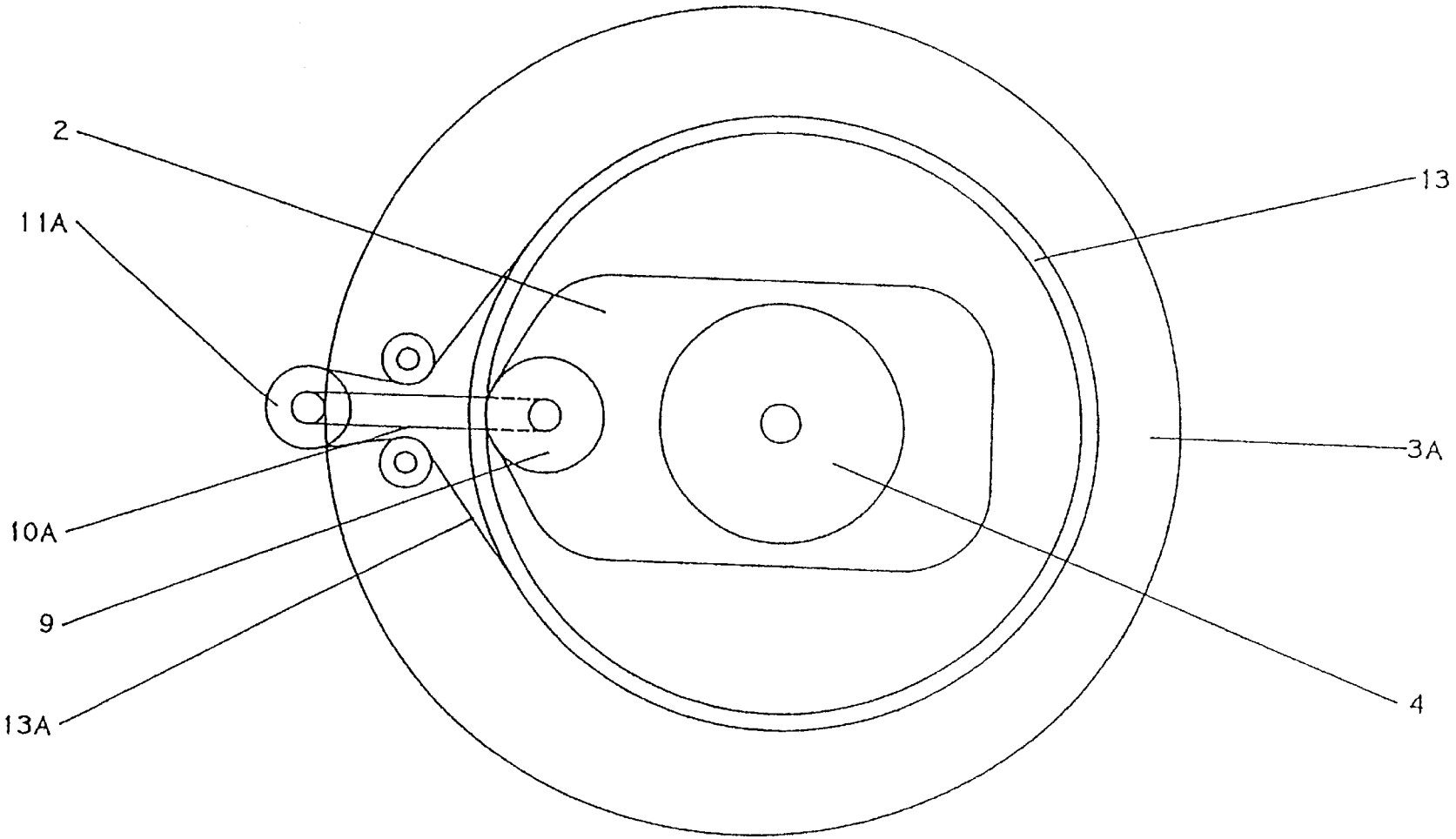
FIG. 3 is a plan view of one alternative arrangement for the first drive mechanism.

The first drive mechanism includes a motor 9 fixed to the motor mounting plate 2. Fixed upon the shaft of the smaller motor 9, is a pulley 10. This pulley interacts via a belt 10*a*, with a second pulley 11*a*, to drive a shaft 12. Mounted at the lower end of this shaft is a third pulley 11*b*. This pulley (11*b*) then interacts with the pulley 13 via a belt 13*a*, as best seen in FIGS. 1 and 3. The interaction between the top drive motor 9 and the top drive pulley via the series of belts and pulleys is termed the "top drive system".

The second drive mechanism includes a motor 4 which is mounted to motor mounting plate 2, and has a shaft 4*a* on which the drive pulley 4*b* is attached. The drive pulley is stabilized by the drive shaft bearing assembly 4*c* and accompanying bearing 4*d*.

Figure 2:
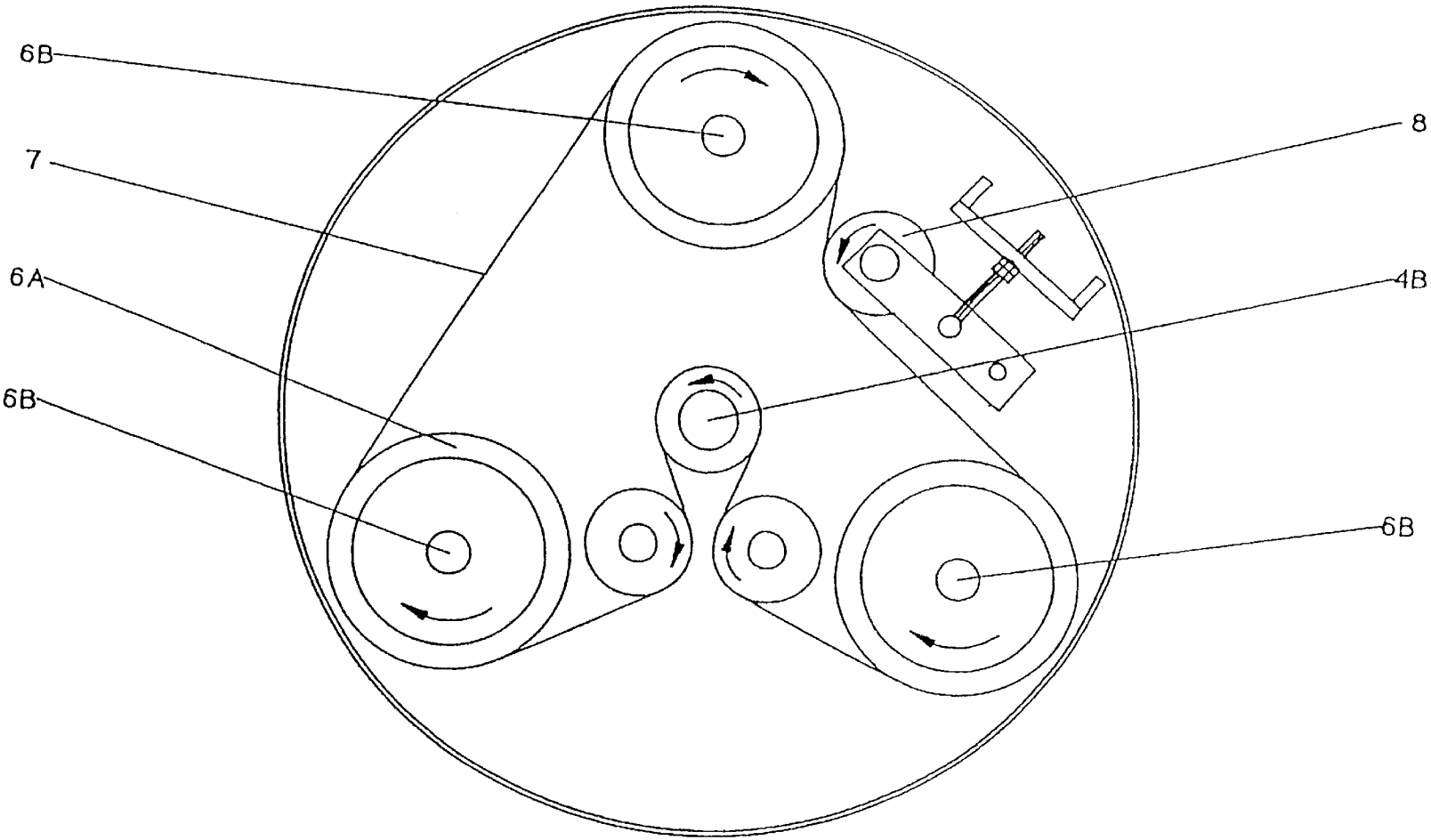
FIG. 2 is a plan view of the second drive mechanism showing the operative connection that drives the satellite heads and their accompanying shafts.

The drive pulley 4*b* is operatively connected to the satellite heads 6 by the primary drive belt 7 running around the belt pulleys 6*a*, which are in turn mounted on the satellite head shafts 6*b*. This arrangement can best be appreciated in FIG. 2. To ensure optimum belt tension during operation, an adjustable belt-tensioning device 8 is provided. This tensioning device also facilitates servicing of the machine, as belt tension can be applied following assembly of parts, unlike in previously disclosed machines, where the drive belt has to be stretched over the belt pulleys. It will be appreciated that the arrangement in the previously disclosed machines provides great difficulty assembling the machine from that point on. The interaction of drive pulley 4*b*, primary drive belt 7, belt pulleys 6*a* and belt tensioner 8 form the mechanism for the "bottom drive system".

Rotatably mounted in the planetary head 3 are three satellite head shafts 6*b* that exit through both the top 3*a* and bottom 3*c* plates of the planetary head. A top bearing assembly including a top bearing housing 6*d* and top bearing 6*e* and a bottom bearing assembly made up of a bottom bearing housing 6*c* and bottom bearing 6*f* achieves their rotational status. Mounted to the bottom end of the satellite shafts 6*b* are the surfacing discs 6*g*, which are actively involved in surfacing the floor.

In operation, the apparatus, including the control chassis (not shown), is moved by the operator over the floor to be surfaced. By selecting the amount of drive to be provided to the planetary head by the motor 4 the operator can control the speed of rotation of the planetary head. The direction of rotation of the planetary head can be controlled by driving in either a forward or reverse direction. Likewise, by controlling the amount of drive provided by the motor 9, the operator can control the speed and direction of rotation of the satellite heads 6, and motors 4 and 9 are controlled independently. Accordingly, the direction and rate of rotation of the planetary head 3 and the secondary heads 6 can be controlled separately by the operator.

It will be appreciated that the rate of rotation of the planetary head 3 essentially controls the amount of time that the satellite heads 6 spend in contact with a given portion of the floor, and the rate of rotation of the satellite heads 6 is determinative of the amount of grinding applied to the floor. Hence, if the rate of rotation of the planetary head 3 is slowed down because a floor is rough, the rate of rotation of the secondary head 6 can be maintained, so the rate of production is maintained, but without the risk that the planetary head will bounce on the rough surface and cause damage to the floor being surfaced. Similarly, if only a small amount of material is to be removed, the planetary head 3 can be driven at a high rate to reduce the contact time of the satellite heads 6 with any given portion of the floor and/or the rate of rotation of the satellite heads 6 can be reduced. Control of the planetary head speed independently from the satellite heads is not possible in the prior art arrangements, where the direction and speed of rotation of the planetary head is determined by the amount of drive provided to the satellite heads.

Those skilled in the art will appreciate that the invention described herein is susceptible to variations and modifications other than those specifically described. It is to be understood that the invention includes all such variations and modifications which fall within the spirit and scope of the invention.

I claim:

1. A mobile surfacing machine including a frame to which a planetary head is rotatably mounted, at least one satellite head rotatably mounted within the planetary head, the at least one satellite head being adapted for grinding a surface, a first drive means for driving the planetary head and a second drive means for driving the at least one satellite head wherein the first drive means and the second drive means are independently operable.

2. A mobile surfacing machine according to claim 1, wherein the machine has one of three satellite heads and four satellite heads.

3. A mobile surfacing machine according to claim 2, wherein each of the satellite heads includes a surfacing disc arranged on a corresponding shaft rotatably mounted within the planetary head.

4. A mobile surfacing machine according to claim 3, wherein the second drive means includes a belt pulley mounted to the shaft of the at least one satellite head and a drive belt for connecting the drive pulley to a first motor mounted on the frame.

5. A mobile surfacing machine according to claim 4, wherein the second drive means further includes a drive belt tensioning device.

6. A mobile surfacing machine according to claim 5, wherein the drive belt tensioning device includes a tensioning pulley around which the drive belt also passes.

7. A mobile surfacing machine according to claim 2, wherein the second drive means includes a belt pulley mounted to the shaft of the at least one satellite head and a drive belt for connecting the drive pulley to a first motor mounted on the frame.

8. A mobile surfacing machine according to claim 7, wherein the second drive means further includes a drive belt tensioning device.

9. A mobile surfacing machine according to claim 8, wherein the drive belt tensioning device includes a tensioning pulley around which the drive belt also passes.

10. A mobile surfacing machine according to claim 1, wherein the at least one satellite head includes a surfacing disc arranged on a corresponding shaft rotatably mounted within the planetary head.

11. A mobile surfacing machine according to claim 10, wherein the second drive means includes a belt pulley mounted to the shaft of the at least one satellite head and a drive belt for connecting the drive pulley to a first motor mounted on the frame.

12. A mobile surfacing machine according to claim 11, wherein the second drive means further includes a drive belt tensioning device.

13. A mobile surfacing machine according to claim 12, wherein the drive belt tensioning device includes a tensioning pulley around which the drive belt also passes.

14. A mobile surfacing machine according to claim 1, wherein the second drive means includes a belt pulley mounted to the shaft of the at least one satellite head and a drive belt for connecting the drive pulley to a first motor mounted on the frame.

15. A mobile surfacing machine according to claim 14, wherein the second drive means further includes a drive belt tensioning device.

16. A mobile surfacing machine according to claim 15, wherein the drive belt tensioning device includes a tensioning pulley around which the drive belt also passes.

17. A mobile surfacing machine according to any one of the preceding claims, wherein the first drive means includes a second motor which drives the planetary head via a series of geared pullies and shafts.

* * * * *